United States Patent [19]

Gilreath

[11] Patent Number: 4,531,504

[45] Date of Patent: Jul. 30, 1985

[54] BALL EXPELLING DEVICE

[76] Inventor: Donald L. Gilreath, 3181 W. 95th Ave., Westminster, Colo. 80030

[21] Appl. No.: 462,466

[22] Filed: Jan. 31, 1983

Related U.S. Application Data

[63] Continuation-in-part of Ser. No. 212,843, Dec. 4, 1980, abandoned, which is a continuation of Ser. No. 936,565, Aug. 24, 1978, abandoned, which is a continuation-in-part of Ser. No. 902,976, May 4, 1978, abandoned.

[51] Int. Cl.[3] ..... F41B 15/00

[52] U.S. Cl. ..... 124/78; 124/49; 273/26 D

[58] Field of Search ..... 124/78, 49, 41 R, 83; 273/26 D

[56] References Cited

U.S. PATENT DOCUMENTS

| | | | |
|---|---|---|---|
| 3,538,900 | 11/1970 | Samuels | 124/78 |
| 3,766,901 | 10/1973 | Clearly et al. | 124/78 |
| 3,785,358 | 1/1974 | D'Angelo et al. | 124/78 |
| 3,811,421 | 5/1974 | Betten | 124/78 |

FOREIGN PATENT DOCUMENTS

| | | | |
|---|---|---|---|
| 0039430 | 3/1977 | Japan | 124/78 |

*Primary Examiner*—Richard J. Apley
*Assistant Examiner*—William R. Browne
*Attorney, Agent, or Firm*—Young & Martin

[57] ABSTRACT

A ball expelling device has a pair of soft, counter-rotating, coacting wheels mounted in a housing container on a pair of parallel spaced axles. A ball feed tube terminates in an outlet opening defined by a pair of opposed fingers at a location between opposed peripheral surfaces of the wheels. The ball feed tube is selectably positionable so that the outlet opening is moveable both in a direction perpendicular to the plane of the wheels and in a direction perpendicular to the plane of the wheel axles. A drive assembly operates to counter-rotate the wheels and preferably includes a pair of step-cone drive pulleys mounted on a pair of parallel drive axles with the drive pulleys each connected by a v-belt to a respective multi-stage pulley mounted on a wheel axle. The drive axles are interconnected by a transmission so that rotation of one drive axle causes rotation of the other drive axle in an opposite angular direction with equal magnitude. A power source, such as an internal combustion engine, rotates a drive shaft which supports a centrifugal clutch that is linked to a pulley on one of the drive axles in order to forcibly rotate the drive axle. A collapsible support structure operates to support the container for use in expelling a ball.

20 Claims, 5 Drawing Figures

BALL EXPELLING DEVICE

RELATED APPLICATIONS

This application is a continuation-in-part of my application Ser. No. 212,843 filed Dec. 4, 1980, now abandoned which was a continuation of Ser. No. 936,565 filed Aug. 24, 1978 now abandoned which was a continuation-in-part of my application Ser. No. 902,976 filed May 4, 1978 now abandoned.

BACKGROUND OF THE INVENTION

The present invention relates to a ball expelling device adapted to expel a ball under force for various recreational activities. Particularly, the present invention relates to a ball expelling device adapted to pitch baseballs for batting and fielding practice.

Heretofore, ball pitching or throwing devices have been developed wherein a pair of counter-rotating wheels are operative to grip a ball and throw the ball from the machine by interaction between opposed peripheral edges of the rotating wheels. Such machines have been devised, for example, to pitch baseballs for batting practice so that batter may improve his swing. Other machines throw ground balls or flys to fielders to improve their fielding. Thus, these machines are quite useful in that they eliminate the need for a person either to pitch the ball to the batter or to hit the ball to fielders for fielding practice. While these prior devices have been capable of projecting straight balls, curve balls, line drives and ground balls, there has been difficulty in the prior art devices in providing structure which is adjustable to provide a large variety of pitches in a reproduceable manner.

As noted, the prior art devices have contemplated the use of parallel spaced-apart wheels oriented in a common plane with these wheels counter-rotating to grip the ball and expel the ball from the device. Unfortunately, through, many of the known baseball projecting machines have a number of disadvantages. For example, some of these machines are not able to effectively and simply provide a curve ball, and indeed often it is impossible for these machines to be adjusted to vary the velocity of the ball that is expelled from the device. Further disadvantages are found in the difficulty of adjusting these machines to provide different pitches and, when such adjustment is undertaken, the pitches are not reproduced accurately. Also a common disadvantage on these machines is that the ball feed mechanism is internal of the machine so that the batter or fielder has no indication of the moment in which the pitch will be delivered so that the batter or fielder is not able to anticipate the pitch. Naturally, anticipation of the delivery of the ball allows a player to compensate his motion in reacting to the ball.

The structure of these prior art devices which have enabled some degree of adjustment are often quite complicated and bulky. For example, many prior art devices utilize separate variable speed motors to drive each wheel so that the ball is gripped between a pair of surfaces which are not moving at the same velocity. Accordingly, such machines, have difficulty in reproducing an accuracy and delivery of the pitch.

As result of the fact that these machines are bulky, heavy and unstable, they lack ease of portability. In fact, it is often the situation that these machines are permanently affixed at given location so that there is no portability of the device whatsoever. Further, since many of these machines utilize electrical power sources, it is necessary that they be operated at a location where an electric power is conveniently located which location is not always the best for practice situations.

Accordingly, there is a need for a ball expelling device which is fairly inexpensive to manufacture and economically to use so that a large variety of groups may employ such machines for practice situations, while at the same time providing a machine that is lightweight and portable so that it may be used at a variety of locations. Further, there is a need for a machine that eliminated the requirement of a convenient electrical power source and at the same is uncomplicated in structure yet which is durable over a long period of use. Also, there is a need for a machine that is highly adjustable yet provides reproduceable results without the necessary of different drive mechanisms.

SUMMARY OF THE INVENTION

It is therefore an object of the present invention to provide a novel and useful ball expelling device that is inexpensive to manufacture and economical to use.

Another object of the present invention is to provide a portable ball expelling device that is light in weight and yet is durable in operation over an extended period of use.

A still further object of the invention is to provide a ball expelling device that is constructed in an uncomplicated manner, that is easy to adjust and that provides reproduceable results in expelling a ball to mimic game events in a practice situation.

Yet another object of the present invention is to provide a ball expelling device that is independent of electrical power and utilizes a single internal combustion engine to drive a pair of counter-rotating wheels operative to expel a ball for batting and fielding practice.

A still further object of the present invention is to provide a ball expelling device which is highly adjustable for reproduceable results allowing for variance of the type of pitch provided by the machine and the velocity of the pitch in two different modes of adjustment.

Accordingly, a ball expelling device is provided, according to the preferred embodiment of the present invention, wherein a pair of counter-rotating wheels are mounted in a container-like housing structure. These wheels have facing peripheral surfaces that move in a common direction to grip the ball and expel the ball from the machine. The wheels are driven by a power source, preferably an internal combustion engine, which operates through a drive mechanism. A ball feed tube having a ball inlet opening external of the housing structure is provided to introduce a ball between the counter-rotating wheels with the ball feed tube and an outlet opening internal of the housing structure. Adjustment means is provided to vary the location of the outlet opening with respect to the wheels with adjustment being both in a direction perpendicular to the plane of the wheels as well as in a direction perpendicular to the plane of the axes of rotation of these wheels.

More particularly, the drive means according to the preferred embodiment of the present invention includes a pulley which operates through a transmission box so that a single power source counter-rotates the coacting wheels. In the preferred embodiment a pair of drive axles are mounted in a common plane and are interconnected by a pair of gears so that rotation of one drive axle causes equal and opposite rotation of the other drive axle. Each drive axle supports a step-cone pulley, and these step-cone pulleys are each linked by a v-belt to a multi-stage pulley on a respective axle for each of the wheels. Thus, rotation of one of the drive axles causes both the rotation of its corresponding wheel as well as rotation of the other drive axle. Rotation of the other drive axle then causes rotation of its corresponding wheel at an equal rate but in an opposite direction. One of the drive axles is linked to the power source by means of a variable pitch pulley mounted on the drive axle and a centrifugal clutch mounted on the crank shaft of the power source so that rotation of the crank shaft at a rate above a selected threshold, causes rotation of the clutch mechanism and thus, through a v-belt, causes rotation of the variable pitch pulley.

Preferably, the ball feed tube is adjustable, as noted, in two degrees of motion and terminates at a outlet opening defined by a pair of spaced-apart fingers which are oriented 180 degrees apart from one another and are separated by a pair oppositely oriented slots. Preferably, the peripheral surfaces of each of the coacting wheels are curved in a direction perpendicular to the plane of the wheels so that the peripheral surfaces arc into the slots. Thus, a ball inserted through the ball feed tube is positively gripped by the coacting wheels while it is between the opposed fingers. Hence, the type of pitch may be varied by varying the rate of rotation of the power source, by varying the linkage of the step-cone pulleys to the wheel axles, and by adjusting the location of introduction of the ball to the coacting wheels. A collapsible support structure is provided to support the device with this support structure including a pair of ground engaging wheels to provide ease of portability with the support structure being foldable so that it may be collapsed to a reduced volume for ease of storage and transportation.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

Figure 1:
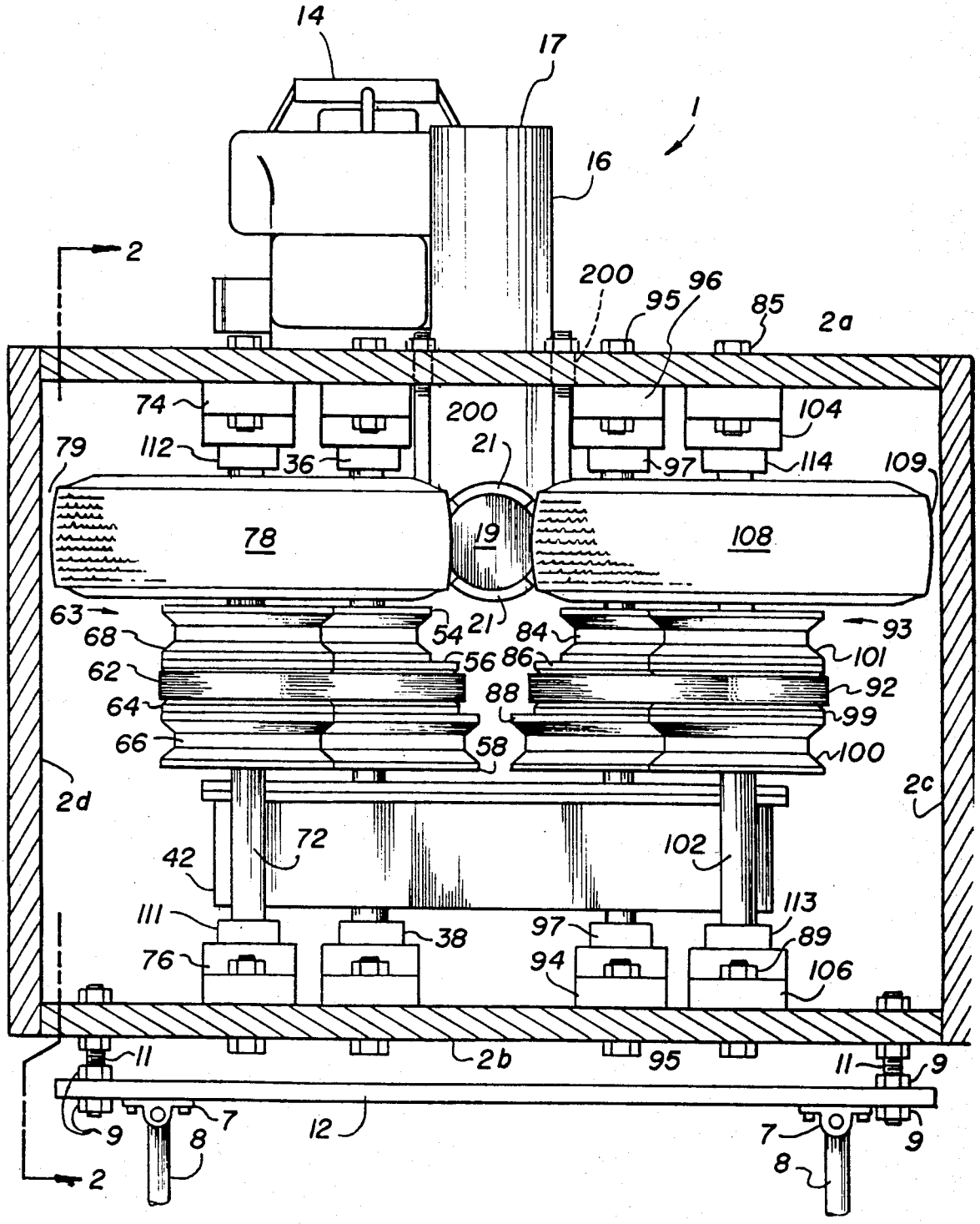
FIG. 1 is a front elevational view in partial cross section showing a ball expelling device according to the preferred embodiment of the present invention.

The present invention relates to a ball expelling device adapted to expel or project a ball, such as baseball, in a reproduceable, predictable manner. The invention is designed to pitch a ball such as a baseball, for batting practice as well as provide a device which can expel balls for fielding practice. Thus, the device can throw "fly" balls as well as "grounders". The structure of the device has a wide range of adjustment so that the mode of operation, the type of pitch, the type of spin and other parameters affecting the flight a ball expelled from the preferred embodiment of the present invention are variable over a full range of practice activities.

In describing the preferred embodiment of the invention illustrated in the drawings, specific terminology will be resorted to for sake of clarity. However, it is not intended to be limited to the specific terms so selected and it is to be understood that each specific term includes all technical equivalents which operate in a similar manner to accomplishe a similar purpose.

Figure 2:
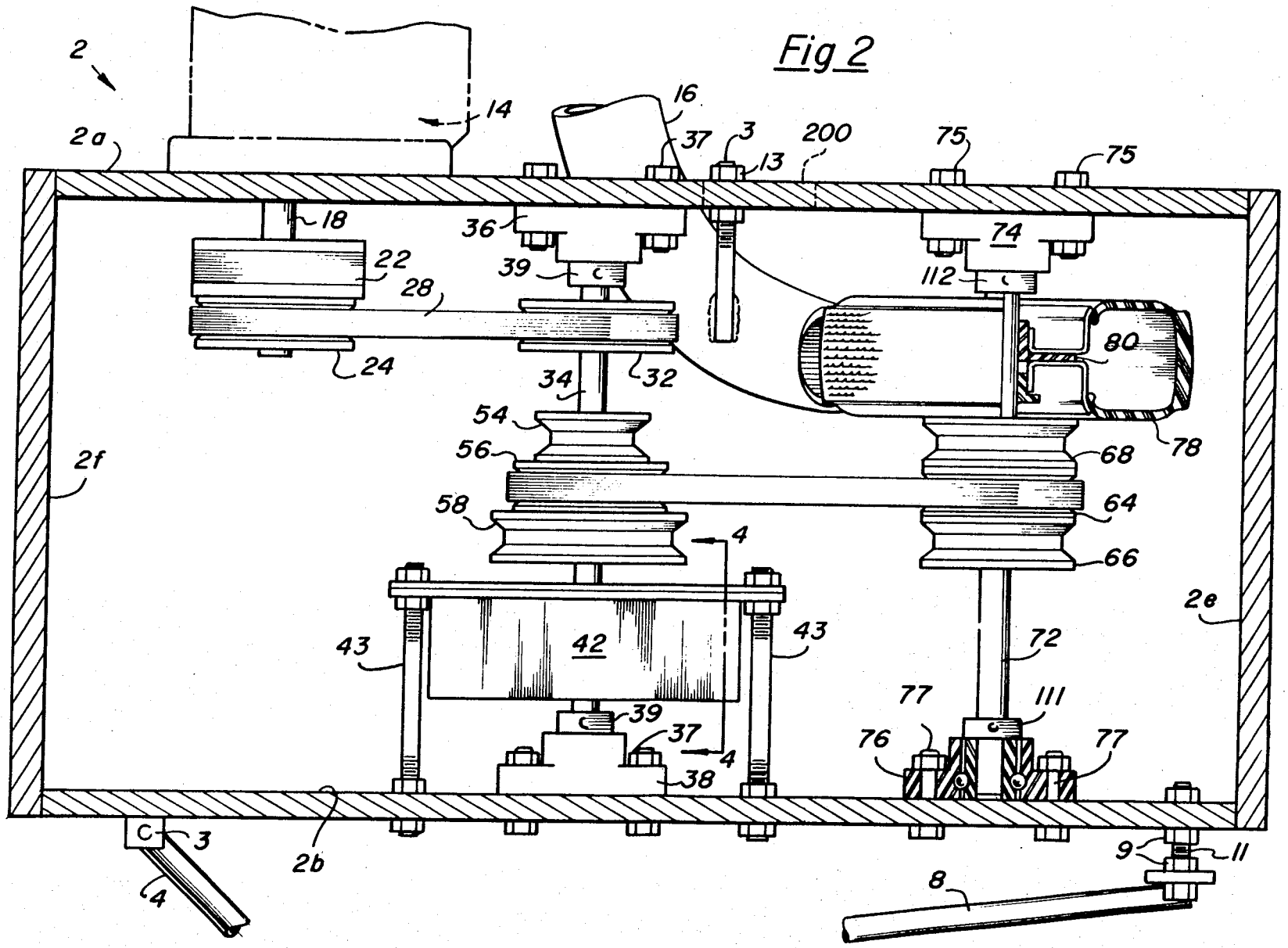
FIG. 2 is a cross sectional view taken along line 2—2 FIG. 1.

Ball expelling device 1, according to the preferred embodiment of the present invention is shown in FIGS. 1 and 2, and includes a housing structure or container 2 having a top wall *2a*, a bottom wall *2b*, side walls *2c* and *2d*, a front end wall *2e* and a back end wall *2f*. Walls *2e* and *2d* are removable to access into the interior of container 2. Container 2 contains the operative mechanism for expelling a ball, such as a baseball, under force, and is supported by means of a support framework 5 including a pair of support legs 4 and a pair of support legs 8. Legs 4 and 8 are hinged together at hinge 10 in a scissor-like manner to allow pivotal movement therebetween. Support legs 4 are pivotly attached to the exterior of housing structure 2 by means of a pair of hing brackets, such as hinge bracket 3 shown in FIG. 2. Hinge brackets 3 are positioned on the exterior surface of bottom wall *2a* adjacent in wall *2f*, and a pair of mounting bolts 11 are attached to at opposite sides of bottom wall *2b* adjacent from end wall *2e*. Bolts 11 mount a brace or plate 12 by means of a plurality of nuts 9 so that plate 12 is maintained in parallel space relation to bottom wall *2b* but the position of plate 12 is adjustable so that spacing therebetween may be altered as desired. Plate 12 mounts a pair of brackets 7 which slideably receive the ends of legs 8.

Figure 5:
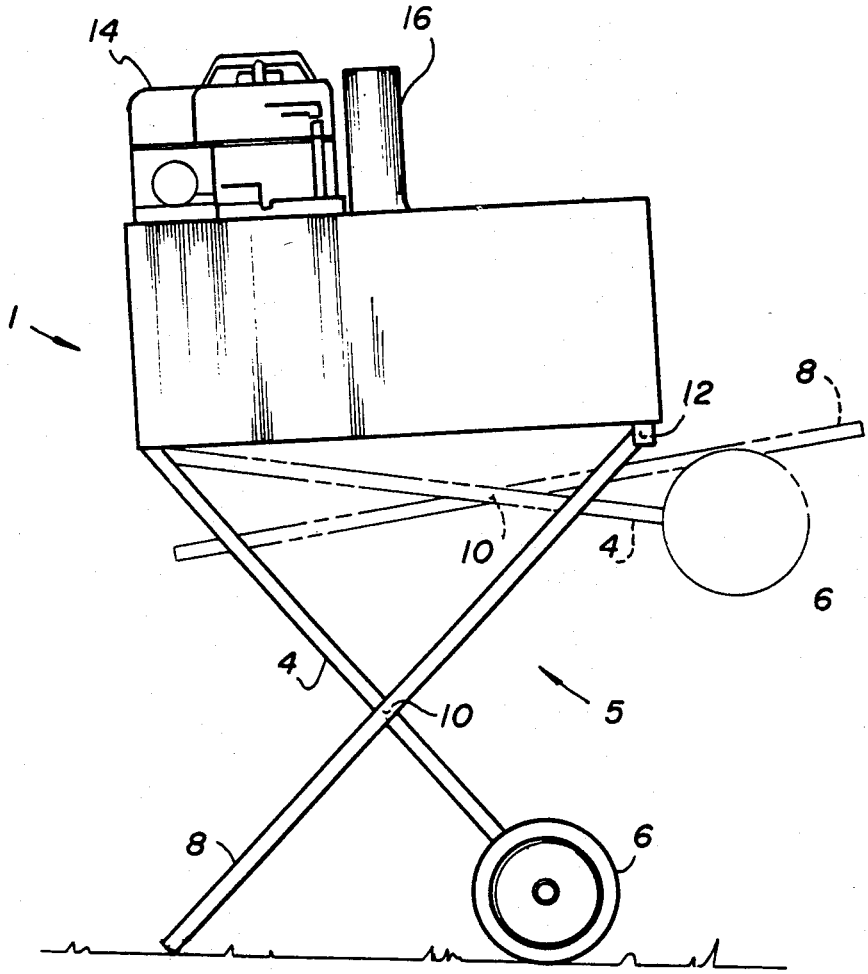
FIG. 5 is a side view in elevation of the ball expelling device shown in FIG. 1.

As is shown in FIG. 5, then, if it is desired to collapse support structure t, a pair of outside nuts 9 are removed from bolts 11, and plate 12 is detached from bolts 11. Legs 4 and 8 are then pivoted with respect to one another so that they are scissored into a collapsed configuration shown in in phantom in FIG. 5. Legs 4 rotatably supported a pair of wheels 6 at a respective free ends so that, when support 5 is arranged in an expanded or support orientation, as is shown in FIG. 5, ball expelling device 1 may be conveniently wheeled to a desired location for use. It should be understood that wheels 6 may be mounted on either legs 4 or 8 without departing from this invention, and, indeed, structure can be provided to selectively mount the wheels on either of legs 4 or 8. Also, it should be appreciated that the device may expell balls in either a leg extended position or in a leg collapsed position depending on the type of practice exercise desired.

Container 2 mounts a power source, such as an internal combustion engine 14 on the upper exterior surface of top wall *2a*. Engine 14 includes a crank shaft 18 which is rotatedly driven by engine 14 to provide rotary motion, with shaft 18 extending into the interior of container 2. It should be understood, though, that different power sources, such as electric motors, could be substituted for internal combustion engine 14 although the use of engine 14 allows for a greater degree of portability of ball expelling device 1, as discussed below. Crank shaft 18 mounts of centrifugal clutch mechanism 22, which includes pulley portion 24. Since clutch 22 is of the centrifugal type, it is automatically engaged when crank shaft 18 attains a preselected desired rate of rotation corresponding to the construction of clutch 22 as is known in the art. When the rpm of engine 14, and thus crank shaft 18, is below this threshold, clutch mechanism 22 automatically disengages so that pulley portion 24 is not driven under force.

To expel a ball under force, a pair of counter-rotating wheels 78 and 108 are provided. Wheel 78 is mounted on a first axle 72 which in turn is rotatably mounted to housing structure 2 by a pair of low friction self-aligning bearings 74 and 76 respectively mounted on top wall *2a* and bottom wall *2b*. Similarly, wheel 108 is mounted on a second axle 102 which is rotatedly journaled between low friction self-aligning bearings 104 and 106 mounted respectively on top wall *2a* and *2b*. Wheels 78 and 108 are oriented in a common plane and have curved peripheral surfaces 79 and 109, respectively, with the surfaces 79 and 109 being in spaced-apart facing relation at a location between axles 72 and 102. Preferably, wheels 78 and 108 are defined by soft pneumatic tires mounted on hubs 80 and 110, respectively, with hubs 80 and 110 being attached to an associated axle 72 and 102.

To allow for adjustable movement of axle 72, bearing 76 is mounted by a pair of bolts 77 in a slot 81 formed in bottom wall *2b*, and bearing 74 is mounted by a pair of bolts 75 to a similarly slot (not shown) in top wall *2a*. Similarly bearing 104, which supports shaft 102 is mounted in a slot 82 formed in top wall *2a* by means of a pair of bolts 85, and bearing 106 is mounted by means of a pair of bolts 89 in a slot 87 formed in bottom wall *2b*. Accordingly, slots 81 and 87 are parallel to one another and are oriented perpendicularly to the plane defined by axles 72 and 102. It should then be appreciated that a first plane is defined by wheels 78 and 108 while a second plane is defined by the axles 72 and 102 with the second plane being perpendicular to the first plane. Locks 111 and 112 are provided at opposite ends of the axle 72 to position axle 72 between bearings 74 and 76, and a pair of locks 113 and 114 position shaft 102 between bearings 104 and 106.

It should be appreciated and understood that rotation of axles 72 and 102 causes rotation of wheels 78 and 108. To accomplish rotation of those axles, a drive assembly is provided to interconnect axles 72 and 102 with clutch 22, which is driven by internal combustion engine 14. Further, in order to expel a ball from the device, it is necessary that wheels 78 and 108 counter-rotate so that the facing peripheral surfaces 79 and 109 move in a common direction between wheels 78 and 108.

Figure 4:
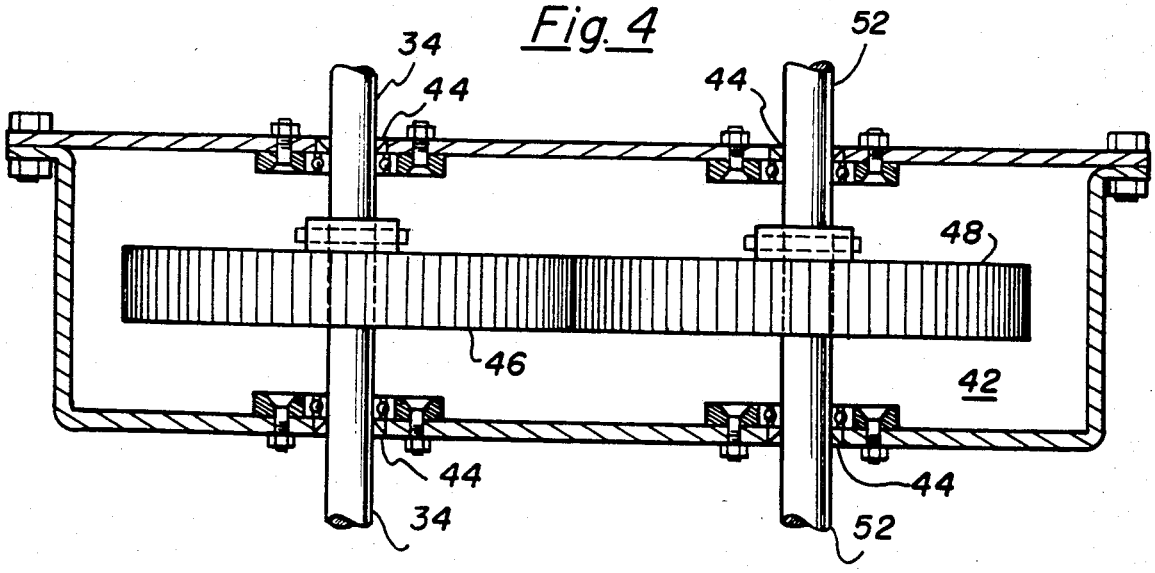
FIG. 4 is a cross sectional view of the transmission box taken about line 4—4 of FIG. 2.

To this end, a first drive axle 34 is rotatedly journaled between a pair of low friction self-aligning bearings 36 and 38 mounted respectively to top wall *2a* and bottom wall *2b* by bolts 37 and locks 39. A second drive axle 52 is likewise rotatedly journaled between a pair of bearings 94 and 96 mounted respectively on bottom wall *2b* and top wall *2a* by bolts 95. Locks 97 likewise position drive axle 52 for rotation between bearings 94 and 96. First drive axle 34 and second axle 52 pass through a transmission box 42 which is mounted to bottom wall *2b* by a plurality of bolts 43 extending upwardly therefrom. Transmission box 42 carries a pair of gears 46 and 48, shown in FIG. 4, which are equal in size and mesh with one another so that rotation of one of gears 46 and 48 causes rotation of the other gear in an opposite direction but with equal magnitude. Grease seals 44 are conveniently mounted in transmission box 46 and receive drive axle 34 and 52 for rotation while preventing loss of lubricant.

Figure 3:
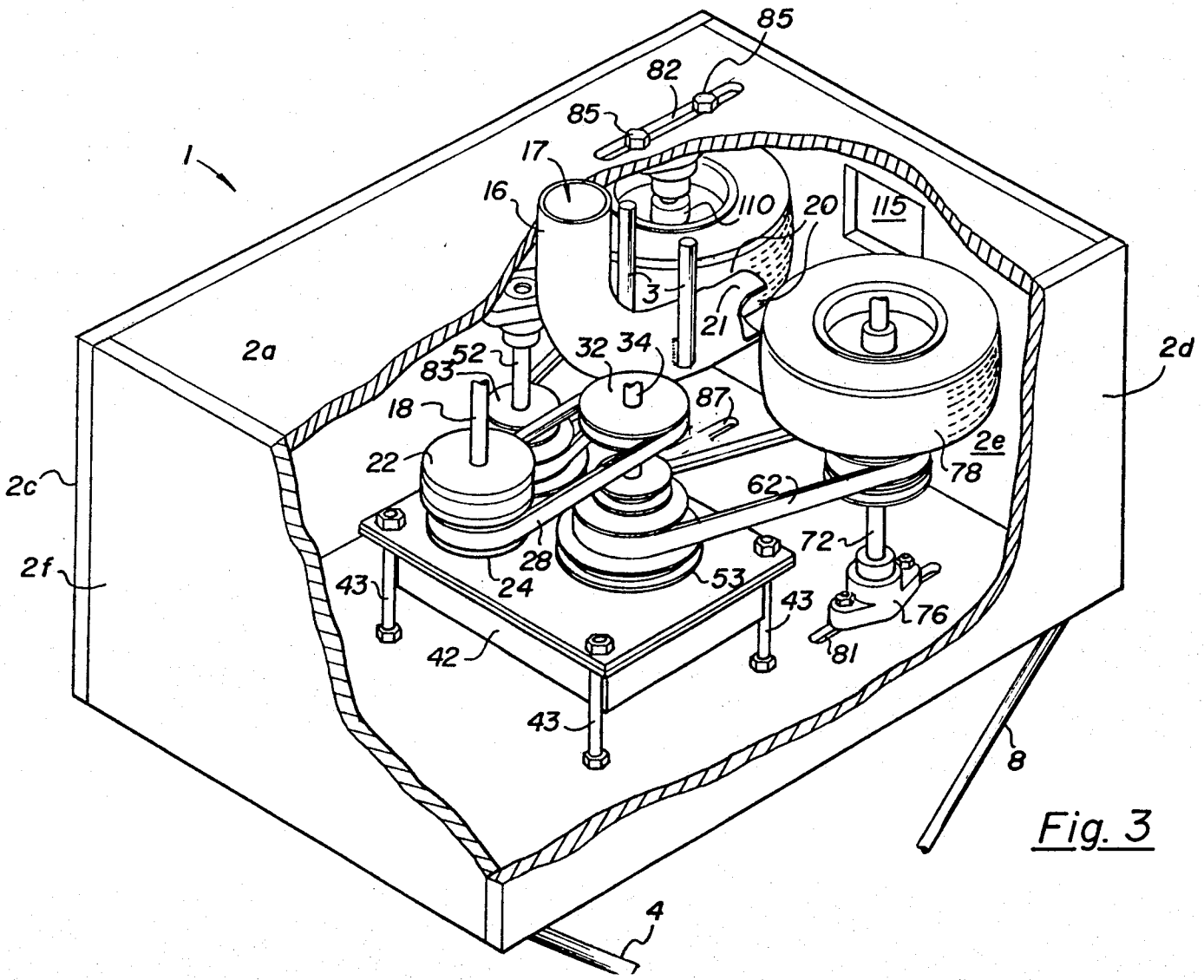
FIG. 3 is a perspective view in partial cross section showing the ball expelling device of FIG. 1.

Drive axle 34 is powered by means internal combustion engine 14 by means of a pulley and v-belt assembly. Specifically, as is shown in FIGS. 2 and 3, a pulley 32 is attached to drive axle 34 so that rotation of pulley 32 causes axle 34 to rotate as well. Preferably, pulley 32 is a variable pitch pulley of the type known in the art, and it should be appreciated that pulley 32 could be mounted just as easily on second drive axle 52 for operation of the device since drive axles 34 and 52 are interconnected by gears 46 and 48. Selection of a proper drive axle may be determined by the direction of rotation of the drive shaft 18, which is especially true where an internal combustion engine is the power source. A standard v-belt 28 links pulley portion 24 of centrifugal clutch 22 to pulley 32, so that, when the speed of crank shaft 18 reaches to the threshold rate of rotation, clutch 33 engages to cause pulley portion 24 to drive variable pitch pulley 32 thus rotating drive axles 34 and 52.

Drive axles 34 and 52 in turn cause rotation of first and second axles 72 and 102, also utilizing a pulley and belt structure. Particularly, a first drive pulley 53 is attached to drive axle 34 and second drive pulley 83 is attached to second drive axle 52 so that rotation of a respective drive axle causes rotation of each pulley 53 and 83. Both pulleys 53 and 83 are of the step-cone type having three pulley steps. That is, step-cone pulley 53 has a first step 54, a second step 56, and a third step 58 with these steps being a pulley sections increasing in diameter. Likewise, step-cone pulley 83 has three pulley steps, step 84, step 86 and step 88, in increasing diameter size. Accordingly, step-cone pulleys 53 and 83 are of common configuration so that they will rotate at an equal velocity in opposite directions.

Axles 72 and 102 each mount a multi-stage pulley; axle 72 mounts a multi-stage pulley 63 and axle 102 mounts a multi-stage pulley 93. Multi-stage pulley 63 is formed of three identical pulleys stage steps 64, 66, and 68 while multi-stage pulley 93 is formed of three equal stages 99, 100, and 101. All of these stages of pulleys 63 and 93 have a common diameter with respect to one another, and each stage of pulleys 63 and 93 corresponds to a respective step on an associated step-cone pulley 53 and 83. Pulley 53 is linked with pulley 63 by means of a standard v-belt 62 and pulley 83 is linked to pulley 93 by means of similar v-belt 92.

Operation of the assembly and drive wheels 78 and 108 may now be more fully appreciated with the above description of structure. Specifically, internal combustion engine 14 is started and is powered so that is rotates crank shaft 18 at a rate of rotation in excess of the threshold for centrifugal clutch 22 so that centrifugal clutch 22 will be engaged to drive pulley 24. This in turn causes rotation of variable pitch pulley 32 through v-belt 28. Rotation of pulley 32 causes a rotation of drive axle 34 which in turn causes rotation of pulley 53 and correspondingly, rotation of drive axle 52 and pulley 83 by way of transmission box 42 and gears 46 and 48. Pulleys 53 and 83 thus rotate at an equal rate but in opposite directions. Rotation of pulleys 53 and 83 causes v-belts 62 and 92 respectively to drive pulleys 63 and 93. This causes axles 72 and 102, respectively, to rotate. Axles 72 and 102 in turn drive corresponding wheels 78 and 108 to that wheels 78 and 108 rotate at equal rates but in opposite directions. As engine 14 is accelerated further, such acceleration advances the rate of rotation of wheels 78 and 108.

A ball is introduced between wheel 78 and 108 so that it is gripped by peripheral surfaces 79 and 109 and expelled from the assembly. To accomplish this, an adjustable feed tube 16, formed in a generally L-shaped configuration, is provided, and a ball exit opening 115 is also provided in frontend wall *2e*. Ball feed tube 16 has an inlet opening 17 and an outlet opening 19 with inlet 17 being located exteriorly of housing structure 2, through top wall 2.

Ball feed tube 16 is generally circular in cross-section and is provided with a pair of slots 20, as is shown in FIG. 3, with slots 20 being oriented 180 degrees apart and are positioned so that peripheral surfaces 79 and 109 may extend slightly into these slots. Thus, slots 20 are oriented generally in the common plane defined by wheels 78 and 108. Further, slots 20 define a pair of fingers 21 which are oriented above one another in a line perpendicular to the first plane defined by wheels 78 and 108. Outlet opening 19 faces exit opening 115 fo that a ball may be gripped by tires 78 and 108 and expelled through exit opening 115 as wheels 78 and 108 rotate.

In the preferred embodiment of the present invention ball feed tube 16 is mounted by means of a pair of bolts 3 and is adjustable over two degrees of freedom. Preferably bolts 3 extend through slots 200 shown in phantom in top wall *2a* similar to slots 81, 82 and 87 so that ball feed tube 16 is adjustable in a direction perpendicular to the plan defined by axle 72 and 102 by moving bolts 3 in these slots so that outlet opening 19 is moved closer and away from exit opening 115. Further, since bolts 3 are threaded, adjustment of nuts 13 permits up and down movement of ball feed tube 16 so that exit 19 is moveable in a direction perpendicular to the plane defined by wheels 78 and 108. Thus, the position of introduction of a ball to coacting wheels 78 and 108 is highly adjustable which allows for reproduceable results in pitches wherein the ball is expelled through exit opening 115.

Specifically, a ball, such as baseball, is introduced into inlet 17 wherein it moved by the force of gravity through ball feed tube 16 to outlet 19. As this ball reaches outlet 19, peripheral surfaces 79 and 109 grip the ball through slots 20 while the ball is between fingers 21. Thus, surfaces 79 and 109 define a pair of rotating surfaces that first converge on outlet 19 and then diverge at a location adjacent exit opening 115 so that the wheels will first grip the ball and then forcibly expel it through exit opening 115. By varying the location of outlet 19, different spins can be imparted on the baseball, and indeed, the ball can be thrown with no spin at all. This ability of adjustment provides a significant departure over the prior art and allows a variety of pitches to be thrown in a reproduceable manner.

Since different baseball players and other ball players have different levels of skills, the present invention also allows for a great degree of variability in the velocity at which the ball is pitched or expelled from ball expelling device 1. First, a variable pulley ratio maybe manually set on the device by moving v-belt 62 onto a selected one of steps 54, 56 and 58 with belt 62 being interconnected to an associated stage on pulley 63. Similarly, belt 92 is moved onto the corresponding one of steps 84, 86 and 88 of step-cone pulley 83 and is mounted on the associated stage of pulley 93. Any slack in belts 62 and 92 can be taken up by positioning axles 72 and 102 by sliding the respective mounting bearings in slots 81, 82 and 87. Once the position of axles 72 and 102 are set, ball feed tube 16 may be adjusted to position outlet opening 19 at the desired location between coacting wheels 78 and 108.

Once the pulley ratio is set, in the above described manner, the velocity of a ball expelled from the device may be varied by varying the rate of rotation of crank shaft 18 by accelerating and de-accelerating engine 14. It should be appreciated, then, that a variable speed motor could replace internal combustion engine 14 without departing from the scope of the invention, but such an electric motor requires a source of electric power conveniently near ball expelling device 1 is portable to a variety of location, remote from electrical power sources so that it is very portable in operation. Also, it should be appreciated that, by utilizing soft pneumatic tires for wheels 78 and 108, faster rotation of the wheels causes their diameters to increase due to centripetal acceleration forces so that they more positively grip a ball at higher speeds. By providing collapsible support structure 5, the device may be conveniently folded and transported in a vehicle, or stored in a compact manner for ease of use. Further, by providing the above described structure, the device is relatively light and yet durable while utilizing relatively inexpensive, off the shelf parts for construction.

While the present invention has been described with some degree of particularity, such should not be construed as limitations on the scope of the invention, but rather as an exemplification of one preferred embodiment thereof. Many other variations are possible, for example, parts may be reversed, various changes may be made in the shape, size, and arrangement of parts. Thus, it should be appreciated that the present invention is defined by the following claims construed in light of the prior art so that modification or changes may be made to the preferred embodiment of the present invention without department from the inventive concepts contained herein.

I claim:

1. A ball expelling device adapted for forceably expelling a ball in a variable manner, comprising:

a container having a ball exit opening;

a first wheel having a first peripheral surface and mounted on a first axle, said first axle journaled for rotation in said container;

a second wheel having a second peripheral surface and mounted on a second axle, said second axle journaled for rotation in said container, said first and second axles being oriented in substantially parallel relation to one another whereby said first and second wheels are positioned in a generally common first plane with said first and second peripheral surfaces in facing relation to one another, said first and second axles defining a second plane;

drive means associated with said first and second wheels for rotating said first and second wheels in opposite directions;

a ball feed tube having an inlet opening and an outlet opening, said tube being mounted in said container such that said outlet opening is positioned between said first and second peripheral surfaces;

a first adjustment means connected to said tube for moving said outlet opening in a first direction generally perpendicular to said first plane;

a second adjustment means connected to said tube to permit said outlet opening to move in a second direction generally perpendicular to said second plane, said first and second adjustment means operable independently of one another so that said outlet opening may be moved independently in two different directions, and said first and second adjustment means enabling the outlet opening to be adjustably positioned relative to the first and second wheels so as to vary the types of pitched balls.

2. A ball expelling device according to claim 1 wherein said drive means includes a pulley assembly including a first pulley mounted on said first axle, a second pulley mounted on said second axle, a first drive pulley mounted for rotation in said container and interconnected to said first pulley by a first belt, a second drive pulley mounted for rotation in said container and interconnected to said second pulley by a second belt, interacting means interconnecting said first and second drive pulleys for causing counter-rotation of one of first and second drive pulleys when the other of said first and second drive pulleys is rotated, and rotational power means for rotating said one of said first and second drive pulleys.

3. A ball expelling device according to claim 2 wherein said first drive pulley is mounted on a first drive axle and said second drive pulley is mounted on a second drive axle, said interacting means including a first gear element attached to said first drive axle and a second gear element attached to said second drive axle, said first and second gear elements meshing with one another whereby rotation of one drive axle causes equal rotation of the other drive axle in an opposite direction.

4. A ball expelling device according to claim 2 wherein said power means includes an internal combustion engine having a drive shaft and a centrifugal clutch mounted on said drive shaft, and a drive assembly associated with said centrifugal clutch and said one of said first and second drive pulleys and operative to cause rotation of said drive pulleys when a threshold rotational speed is attained by said drive shaft.

5. A ball expelling device according to claim 4 wherein said first drive pulley is mounted on a first drive axle and said second drive pulley is mounted on a second drive axle, said drive assembly means including a third pulley mounted for rotation in response to rotation of said drive shaft, and including a fourth pulley mounted on one of said first and second drive axles and a third belt interconnecting said third and fourth pulleys.

6. A ball expelling device according to claim 5 wherein said fourth pulley is a variable pitch pulley.

7. A ball expelling device according to claim 2 wherein said power means includes an electric motor having a drive shaft and a drive assembly interconnecting said drive shaft and said one of said drive pulleys and operative to cause rotation of said drive pulleys upon rotation of said drive shaft.

8. A ball expelling device according to claim 2 wherein said first and second pulleys are each multistage pulleys wherein each stage thereof have common diameter and said first and second pulleys have a common diameter with one another and wherein said first and second drive pulleys are step-cone pulleys with each step corresponding to a stage of its associated one of said first and second pulleys, said first and second belts each selectably positionable on a selected one of the steps of said first and second drive pulleys.

9. A ball expelling device according to claim 8 wherein said first and second axles are adjustably mounted in said container and are moveable in a direction parallel to said first plane whereby tension on said first and second belts may be maintained at a desired magnitude.

10. A ball expelling device according to claim 1 wherein said ball feed tube has an L-shaped configuration and is mounted to said container with said inlet opening accessible exteriorly thereof and in an orientation above said first plane, said exit opening positioned adjacent said outlet opening, and said first and second wheels being driven in directions whereby a ball introduced into said inlet opening is presented at said outlet opening to said first and second peripheral surfaces by gravity and is subsequently expelled through said exit opening by the force imparted thereto by said first and second wheels.

11. A ball expelling device according to claim 10 wherein said ball feed tube has a pair of diametrically spaced, longitudinal slots at said outlet opening, said slots positioned in said first plane and defining a pair of fingers oriented 180 degrees apart from one another, said first and second peripheral surfaces being curved to project into a respective slot whereby a ball is positively gripped thereby when it is positioned between said fingers.

12. A ball expelling device according to claim 11 wherein said first and second wheels are soft pneumatic tires.

13. A ball expelling device according to claim 1 including a support framework connected to and supporting said container, said framework including a plurality of collapsible leg members and ground engaging wheels mounted on at least two of said leg members.

14. A ball expelling device according to claim 13 wherein said support framework includes a base member and plurality of bolt elements adjustably interconnecting said base member to said container, said leg members being secured to said base member.

15. In a ball expelling device having a housing container, a pair of counter-rotating ball driving wheels rotatably mounted in said housing container in a generally common plane and drive means for forcibly rotating said wheels, the improvement comprising a ball-feed tube and attachment means for adjustably mounting said ball feed tube to said housing container, said ball feed tube having an inlet opening positioned exteriorly of said housing container and an outlet opening positioned between said wheels, said attachment means including first adjusting means for moving said outlet opening in a first direction generally perpendicular to said common plane and including second adjusting means for moving said outlet opening in a second direction perpendicular to a plane defined by the two axes of rotation of said pair of wheels independently of said first adjusting means; and said first and second adjustment means enabling the outlet opening to be adjustably positioned relative to the ball driving wheels so as to vary the types of pitched balls.

16. The improvement according to claim 15 wherein said ball feed tube has a pair of diametrically opposed slots at said outlet opening to define a pair of fingers oriented 180 degrees apart from one another.

17. The improvement according to claim 16 wherein said wheels are soft pneumatic ties having peripheral surfaces curved in a direction perpendicular to said common plane, said outlet opening positionable in an orientation where said peripheral surfaces extend into said slots.

18. The improvement according to claim 15 further including a base member adjustably secured to said container, a collapsible support framework attached to said base member, and a pair of ground engaging wheels rotably secured to said framework.

19. The improvement according to claim 15 wherein said drive means includes an internal combustion engine having a drive shaft and a centrifugal clutch connected to said drive shaft, said wheels being notably drive by a power train through said clutch.

20. A ball expelling device comprising, a housing container having two coacting wheels and a power drive means for rotating each of the wheels in opposite directions, and drive means including an internal combustion engine, a first shaft and a clutch, said clutch having a pulley portion and being connected to said first shaft for rotation therewith, a means interconnecting said pulley portion of said clutch and a first pulley mounted on a drive axle, a means for connecting said drive axle to a second pulley mounted on a second shaft which supports one of the coacting wheels and for connecting said drive axle to a third pulley mounted on a third shaft which supports the other of the coacting wheels, said clutch operating to rotate its pulley portion only after a given speed of the engine has been reached, said second pulley and said third pulley being of the stepped type for permitting different rotational speeds of the said coacting wheels to be obtained, and said device further including an adjustable ball feed tube so as to feed the balls to the coacting wheels in different locations so as to obtain varying ball trajectories.

* * * * *